US009448021B2

(12) United States Patent
Feuvrier-Danziger

(10) Patent No.: US 9,448,021 B2
(45) Date of Patent: Sep. 20, 2016

(54) LINKED AMMUNITION RESTRAINING DEVICE

(76) Inventor: Luc Alexandre Feuvrier-Danziger, San Francisco, CA (US)

( * ) Notice: Subject to any disclaimer, the term of this patent is extended or adjusted under 35 U.S.C. 154(b) by 868 days.

(21) Appl. No.: 13/275,260

(22) Filed: Oct. 17, 2011

(65) Prior Publication Data

US 2013/0092015 A1 Apr. 18, 2013

(51) Int. Cl.
*F41A 9/29* (2006.01)
*F41C 27/00* (2006.01)

(52) U.S. Cl.
CPC *F41A 9/29* (2013.01); *F41C 27/00* (2013.01)

(58) Field of Classification Search
CPC ..... F41A 9/29; F41A 9/30; F41A 9/31; F41A 9/32; F41A 9/33; F41A 9/34; F41A 9/52; F41A 9/86; F41A 9/79; F41A 35/00; F41C 27/00
USPC ..... 42/72, 90, 106; 89/33.5, 34, 35.01
See application file for complete search history.

(56) References Cited

U.S. PATENT DOCUMENTS

| | | | | |
|---|---|---|---|---|
| 2,365,028 | A * | 12/1944 | Vesely | 89/35.01 |
| 3,611,607 | A * | 10/1971 | Donnell | 42/106 |
| 3,744,170 | A * | 7/1973 | Jensen | 42/87 |
| 4,875,303 | A * | 10/1989 | DeWeert et al. | 42/90 |
| 6,804,907 | B1 * | 10/2004 | Slobodkin | 42/71.02 |
| 7,805,873 | B2 * | 10/2010 | Bentley | 42/74 |
| 7,913,610 | B2 | 3/2011 | Ulveraker et al. | |
| 8,156,679 | B1 * | 4/2012 | Swan | 42/124 |
| 2004/0060220 | A1 * | 4/2004 | Peddie | 42/71.01 |
| 2005/0217470 | A1 * | 10/2005 | Bevacqua | 89/34 |
| 2010/0011946 | A1 * | 1/2010 | Ulveraker et al. | 89/34 |
| 2010/0154280 | A1 * | 6/2010 | LaFrance et al. | 42/124 |
| 2010/0236389 | A1 * | 9/2010 | Larson et al. | 89/1.42 |

* cited by examiner

*Primary Examiner* — Bret Hayes
*Assistant Examiner* — Derrick Morgan
(74) *Attorney, Agent, or Firm* — Mersenne Law

(57) ABSTRACT

An accessory to improve handling and transportability of a belt-fed firearm attaches to an upper surface of the firearm and provides at least two protrusions extending outward or upward therefrom, the protrusions sized and positioned to engage a portion of the ammunition belt between two rounds of ammunition and to prevent the belt from sliding across the upper surface of the firearm.

1 Claim, 5 Drawing Sheets

Fig. 5A
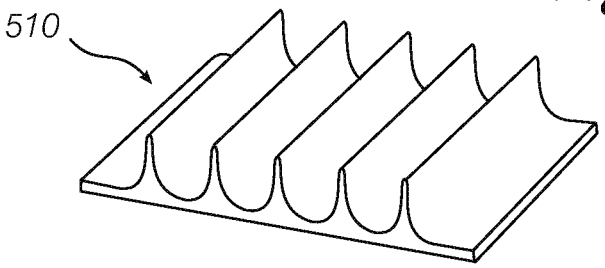
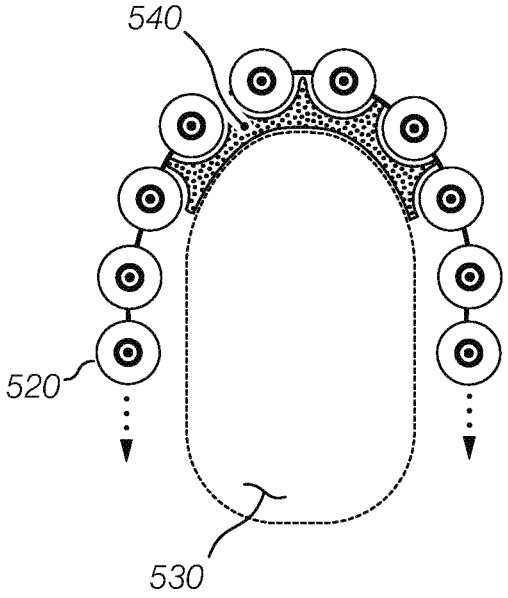
Fig. 5B

LINKED AMMUNITION RESTRAINING DEVICE

CONTINUITY AND CLAIM OF PRIORITY

This is an original U.S. patent application.

FIELD

The invention relates to firearm accessories. More specifically, the invention relates to structural features of a machine gun to improve its handling characteristics when it is not in use.

BACKGROUND

A wide variety of firearms have been developed and used in sport, hunting and combat. One of the most intimidating and effective weapons is the fully-automatic machine gun, which allows its operator to fire continuously at rates of 500, 1,000, or even more rounds per minute. Machine guns were originally large, heavy and temperamental devices, but with the benefit of modern materials and manufacturing techniques, a highly-capable machine gun can be small and light enough to be carried by a single soldier.

Ammunition for a machine gun is often provided as a linked belt or chain of cartridges, each round of which may be identical to the non-linked version used in other types of firearm. The action of the machine gun draws the belt through a feed mechanism to bring live rounds into the firing chamber, and then to expel discharged cases. The action is more complex than that of a non-machine firearm (e.g., a clip-fed semi-automatic pistol), and may be more time-consuming to load and prepare for operation. Consequently, machine guns are often prepared and pre-loaded with a short "starter belt" of ammunition, which can easily be attached to the end of a longer chain of ammunition when the weapon is to be used. (Of course, the rounds of the starter belt are also live, and so the weapon can be fired if necessary even before the main belt is attached.)

The starter belt typically hangs down from the weapon's feed mechanism, and a length containing a useful number of rounds may be 2-3 feet (60-90 cm) long. This heavy, flexible belt can interfere with the motion of a soldier carrying the weapon, and if the end of the belt drags through mud or sand, it can carry those contaminants into the firing mechanism and cause jams or misfires. Some soldiers attempt to prevent this by folding the belt over the barrel of the weapon, but between the weight of the cartridges and the smooth, flexible design of the belt, it is difficult to keep the starter belt from falling or sliding all the way to one side or the other.

A mechanism for securing the starter belt of a belt-fed weapon against such undesired movement may improve the handling and portability of the firearm, and thereby improve the operator's mobility, effectiveness and safety.

SUMMARY

An ammunition restraining device attached to the barrel or other upper surface of a belt-fed firearm, or otherwise formed on the upper surface of the weapon, helps hold a belt of ammunition in place while the weapon is being carried or moved.

BRIEF DESCRIPTION OF DRAWINGS

Embodiments of the invention are illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

FIGS. 5A and 5B show an alternate embodiment of the invention.

DETAILED DESCRIPTION

Figure 1A:
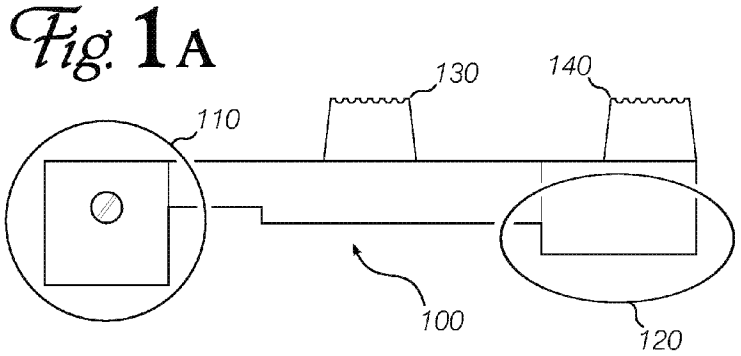
FIGS. 1A-1D show several views of a prototype ammunition restraining device according to an embodiment of the invention.
Figure 1B:
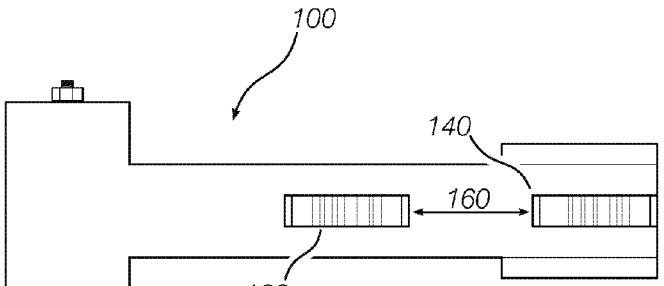
Figure 1C:
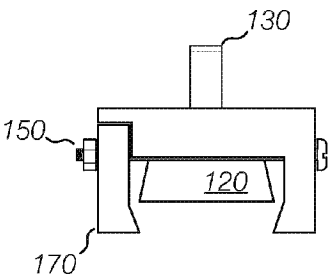

Embodiments of the invention are attached to or formed on an upper surface of a machine gun to prevent a length of linked ammunition draped over the weapon from sliding from side to side while the weapon is being moved. A simple mechanical structure avoids introducing unnecessary complexity that might harm the weapon's reliability.

FIGS. 1A-1D show several views of a prototype ammunition restraining device (generally identified by reference number 100) according to an embodiment of the invention. In side view 1A, a clamping mechanism is visible at 110. This mechanism is used to attach the device to an upper surface of a firearm by clamping it to an accessory rail, scope mount, or other suitable feature of the firearm. This embodiment only has a single attachment point; the other end of the device 120 simply rests on top of the weapon. The device has two protrusions or "fingers," 130 and 140, which extend upward from the top of the device (and from the top of the weapon).

Top view 1B shows a threaded bolt 150 which is used to tighten the clamping mechanism. Protrusions 130 and 140 are visible in this view also. The distance 160 between the protrusions is chosen to suit the ammunition and link or belt system used by the firearm, as described below. Front view 1C shows the moveable portion 170 of the clamping mechanism, one of the protrusions on the top (130) and the rear resting pad 120.

Figure 1D:
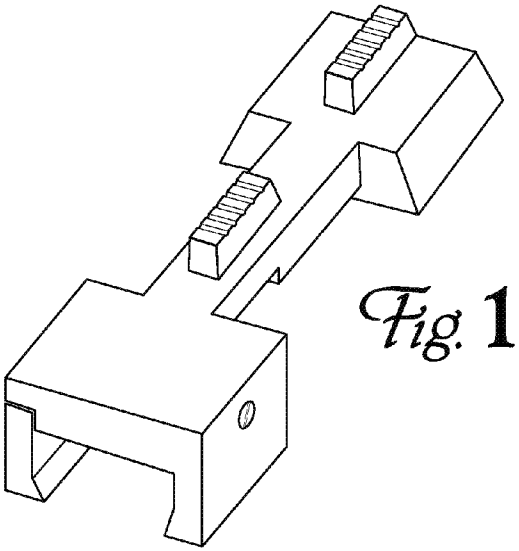

FIG. 1D is a perspective view of the prototype ammunition restraining device.

Although the prototype device shown in FIGS. 1A-1D uses a screw-driven clamping mechanism to secure it to a firearm, those of ordinary skill will appreciate that other attachment methods are also acceptable. For example, a lever-actuated, cam-based clamp may be attractive because it can be adjusted without tools. Multiple clamping mechanisms may provide improved resistance to loosening and inadvertent detachment, at a cost of increased manufacturing complexity and expense. Other embodiments may be secured more-or-less permanently to a firearm by means of latches, expanding pins, threaded fasteners, rivets or the like. For new firearm designs, the improved functionality offered by an embodiment of the invention can be obtained by designing protrusions as described below directly into the weapon barrel, stock, or a similar location.

Figure 2:
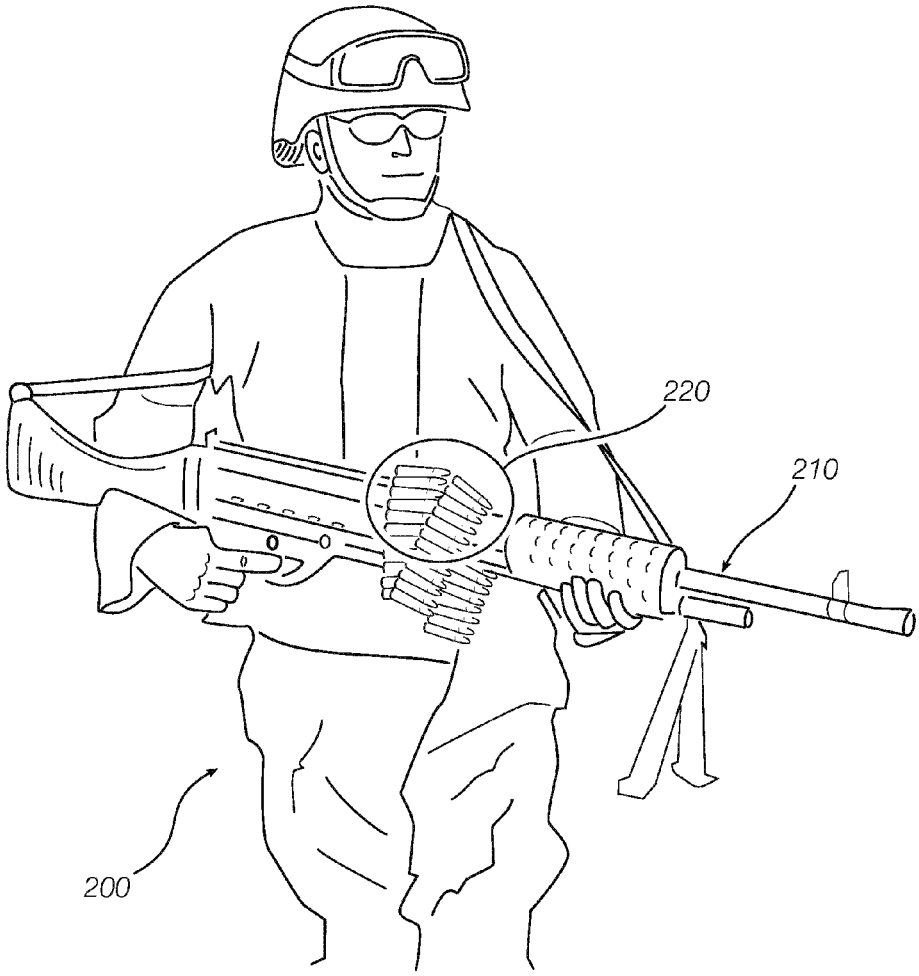
FIG. 2 shows a belt-fed machine gun being carried by a soldier. A short length of linked ammunition is draped across the top of the weapon, where it is secured by an embodiment of the invention.

FIG. 2 shows a soldier 200 carrying a typical belt- or linked-ammunition-fed machine gun 210. A short length of ammunition (a "starter belt") is shown draped across the top of the weapon (circled at 220). An embodiment of the invention, secured to the barrel under the starter belt, helps prevent the belt from sliding off the weapon and interfering with the soldier's movement, becoming tangled in underbrush or fouled with water, mud or sand. Since the embodiment can prevent side-to-side movement of the belt when engaged between any two rounds of ammunition, the belt overhang on either side can be easily adjusted regardless of the length of the starter belt. For longer starter belts, a second embodiment may be attached further forward on the weapon to secure a second side-to-side fold of the belt.

In this condition, the weapon may still be immediately operable, and since the starter belt is merely held in place against the protrusions by its own weight, it can be unfolded quickly and reliably, with no risk of jamming or other failure that might be caused by an attachment clip of greater mechanical complexity.

Figure 3:
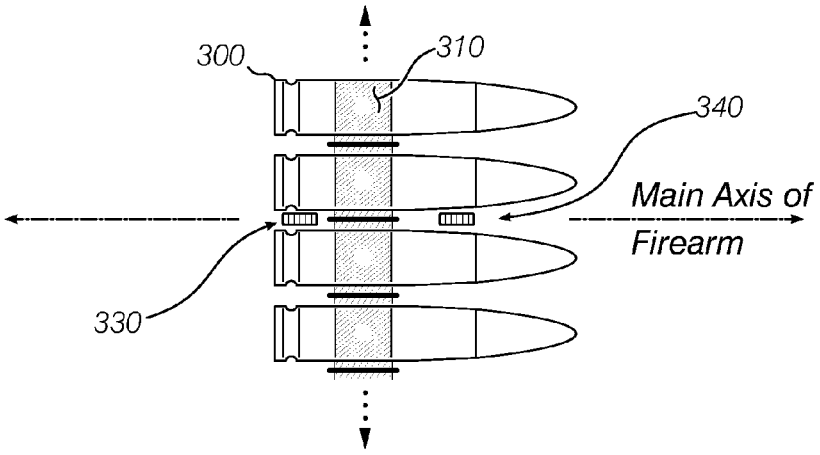
FIG. 3 shows a detail of a portion of an ammunition belt and two protrusions of an embodiment which fit between adjacent shells.

FIG. 3 shows a portion of an ammunition belt, seen from above as it would cross the top surface of a firearm when draped as shown in FIG. 2. In this view, the tops of two protrusions of an embodiment are visible at 330 and 340. The horizontal distance between the protrusions (i.e., the distance along the main axis of the firearm, viz. 160 in FIG. 1B) is less than the length of a round of ammunition 300, but greater than the width of the link or belt material 310. It is preferred that the protrusion spacing be comfortably larger than the belt width, so that the belt need not be draped across the weapon particularly carefully.

Figure 4:
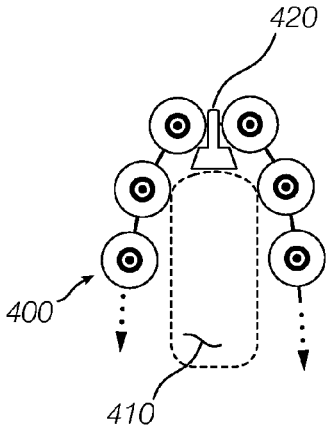
FIG. 4 shows another representative view of a belt-fed firearm with an embodiment of the invention attached to its upper surface.
Figure 6:
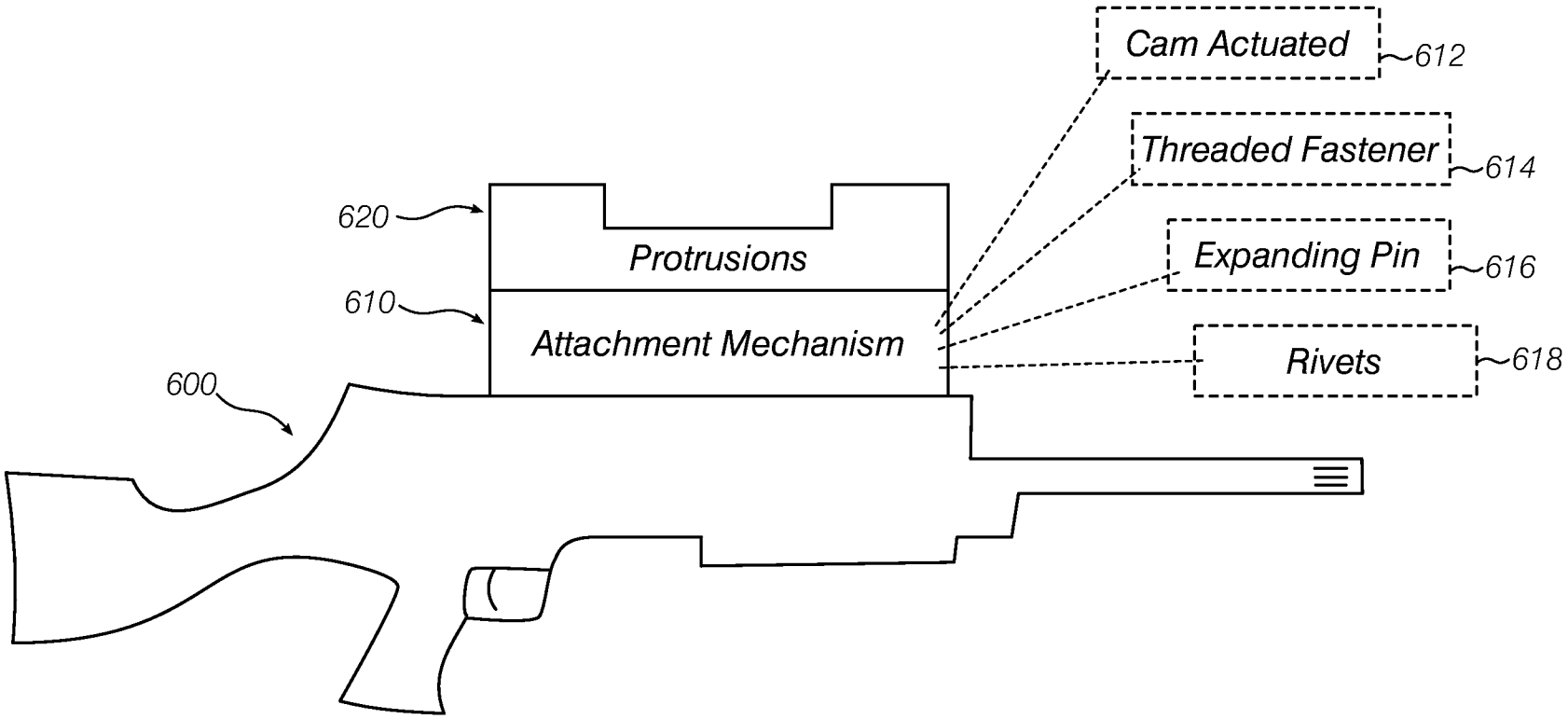
FIG. 6 is a schematic representation of an embodiment of the invention in relation to a firearm.

FIG. 4 shows a rear view of an ammunition belt 400 draped over the body of a firearm 410. At 420, the profile of an embodiment of the invention is shown. The rear protrusion is visible, and can be seen to be slightly shorter than the diameter of a cartridge. A longer (i.e., taller) protrusion might provide an improved securing function, but could also interfere with normal operation of the weapon, while a shorter protrusion might be less effective at preventing sliding. It is preferred that the protrusions extend by a length between ½ and 1½ times the diameter of the cartridge.

FIG. 5A shows an alternate embodiment that may be easier to manufacture, but may be less rugged than the metal or composite, clamp-on version discussed above. A flexible, ridged pad 510 may be made of a polymer or similar material, and attached to the top portion of a weapon by adhesive, screws, or similar means. The plurality of protrusions or ridges are spaced and formed to correspond to the shells in a belt of ammunition, so a belt draped across the pad is held in place somewhat like a chain on a sprocket. This is shown in FIG. 5B, where ammunition belt 520 is draped over a firearm body, seen in profile at 530. The ridged pad is shown end on, shaded, at 540. Fore-and-aft movement can also be restricted by flanges at the front and back of the pad, or by protrusions similar to those of other embodiments described herein. As with other embodiments, ridges like those shown here can be formed directly in the material of the stock, rather than added on afterward.

The applications of the present invention have been described largely by reference to specific examples and in terms of particular allocations of functionality to certain features. However, those of skill in the art will recognize that improved firearm handling characteristics can also be obtained by weapon features different from those specifically illustrated and described above, but that nevertheless fall within the scope of the scope of the following claims. Such features are understood to be captured by the claims, notwithstanding their lack of resemblance to the embodiments depicted in the Figures.

I claim:

1. An accessory for a belt-fed firearm, comprising:

mounting means for attaching the accessory to an upper surface of a belt-fed firearm, said firearm suited for successively firing bullets from a plurality of rounds of ammunition, each of said rounds being generally cylindrical in shape and having a base portion oriented towards an operator of the firearm and a bullet portion opposite the base portion, said bullet being oriented away from the operator of the firearm, each of said rounds of ammunition joined to at least one but no more than two neighboring rounds by a belt linkage, and each of said rounds of ammunition being of similar shape and dimensions, having a common length and a diameter; and a plurality of protrusions extending vertically from an upper surface of the accessory, said protrusions held in alignment by the mounting means so that the protrusions lie on a line that is roughly parallel to a barrel of the firearm, a distance between each pair of such protrusions in a direction of the barrel being less than the length of a round of ammunition including the base portion and the bullet, a height of each protrusion being greater than half the diameter of a round of ammunition, and wherein the mounting means is to secure the protrusions to the firearm so that a belt of ammunition for the firearm, when draped over the protrusions so that one protrusion lies between the base portion of two adjacent rounds of ammunition of the belt, and another, different protrusion lies between the bullet portion of the two adjacent rounds of ammunition of the belt, preventing the belt of ammunition from sliding freely from side to side across the upper surface of the firearm and supporting it so that it may be carried or stored.

* * * * *